United States Patent [19]

Malpas et al.

[11] Patent Number: 4,824,541

[45] Date of Patent: Apr. 25, 1989

[54] FLUID BED ELECTROLYSIS CELL

[75] Inventors: Richard E. Malpas; Gerardus J. C. M. Jansen; Anthonie Honders; Johannes B. J. Spijkerman, all of At Arnhem, Netherlands

[73] Assignee: Shell Internationale Research Maatschappij B.V., The Hague, Netherlands

[21] Appl. No.: 94,248

[22] Filed: Sep. 4, 1987

[30] Foreign Application Priority Data

Sep. 25, 1986 [GB] United Kingdom ..... 8623069
Mar. 9, 1987 [GB] United Kingdom ..... 8705471

[51] Int. Cl.[4] ..... C25D 17/00; C25C 7/00; C25C 7/02

[52] U.S. Cl. ..... 204/222; 204/252; 204/253; 204/290 F; 204/284; 204/279

[58] Field of Search ..... 204/149, 151, 222, 275, 204/290 F, 269, 252–258, 263–266, 284, 279

[56] References Cited

U.S. PATENT DOCUMENTS

| | | | |
|---|---|---|---|
| 3,954,594 | 5/1976 | Recht | 204/151 X |
| 3,966,571 | 6/1976 | Gagnon et al. | 204/149 |
| 4,032,425 | 6/1977 | Kametani | 204/222 X |
| 4,119,518 | 10/1978 | Miller | 204/151 X |

*Primary Examiner*—Donald R. Valentine
*Attorney, Agent, or Firm*—Jones, Tullar & Cooper

[57] ABSTRACT

A fluidized bed electrolysis cell comprising one or more particulate electrodes provided with one or more current feeders carrying on their surfaces a protective film of valve metal oxide, and one or more diaphragms for separating the anode compartments from the cathode compartments in the cell.

12 Claims, No Drawings

FLUID BED ELECTROLYSIS CELL

This invention is concerned with a fluidized bed electrolysis cell of improved design, as well as with the use of such an electrolysis cell, especially for the electrowinning of metals and the dissolution of metal particulates to prepare metal salt solutions.

Fluidized bed electrolysis cells are known in the art, cf. U.S. Pat. No. 4,244,795 and the article appearing in "Chemistry and Industry", July 1, 1978, p 465–467 by Gert van der Heiden, Chris M. S. Roats and Herman F. Boon, entitled: Fluidized Bed Electrolysis for Removal or Recovery of Metals from Dilute Solutions. The fluidized bed electrolysis cells described in these references comprise a particulate metal cathode, one or more conventional anodes and one or more diaphragms, preferably the latter are conceived as tubes or pipes surrounding the anodes. The particulate cathode is fluidized by adjusting the flow of catholyte, a convenient method for assessing the state of fluidization is by measuring bed expansion. One or more current feeders, e.g. wires, rods, strips, plates, tubes or pipes, that are dipped into the particulate cathode, ensure adequate distribution of current over all metal particles. In addition to the fluidized bed electrolysis cells described above, it is also possible to use a particulate metal anode, together with one or more conventional cathodes and one or more diaphragms, preferably the latter conceived as tubes or pipes surrounding the cathodes. The particulate anode is fluidized by adjusting a flow of anolyte. One or more current feeders, e.g. wires, rods, strips, plates, tubes or pipes, that are dipped into the particulate anode, ensure adequate distribution of current over all metal particles.

It will be appreciated that the fluidized bed electrolysis cell may be provided with a particulate metal cathode as well as with a particulate metal anode.

Whilst it has been proposed to employ fluid bed electrolysis using particulate cathodes for the winning of metals from suitable electrolytes such as hydrometallurgical process streams, most of the practical development work that has been carried out to date has been directed towards another use, i.e. the removal of metal ions from waste water streams. As a result the electrowinning of metals by fluid bed electrolysis is to date at best at the initial stage of development and no practical commercial method is available today. Fluid bed electrolysis using particulate metal anodes may be used for the preparation of metal salt solutions by dissolution of the particulate anode-metal.

One of the problems associated with the electrowinning of metals is the need for an undisturbed continuous operation. Deposition of metal on parts or elements of the cell other than the particulate cathode can lead to interruption of the smooth operation of the cell and continued deposition in undesired locations may lead to shortcircuiting of the cell or immobilisation of the fluidized bed of cathode particles, it also adversely affects efficient use of current. Particularly undesirable is the deposition of metal on the current feeders.

One of the problems associated with the dissolution of particulate metal anodes is the need for an insoluble current feeder to allow undisturbed continuous operation.

The present invention is therefore concerned with means for improving the operation of fluidized bed electrolysis cells, particularly when these are employed for the electrowinning of metals from electrolytes and for the preparation of metal salt solutions. Thereto this invention provides a fluidized bed electrolysis cell comprising one or more particulate electrodes provided with one or more current feeders carrying on their surfaces a protective film of valve metal oxide.

Valve metals are defined in this specification to comprise any and all metals or metal alloys which may form a protective oxide layer. Depending on the particular application envisaged suitable cathode valve metals are a.o. Al, Bi, Ge, Hf, Mg, Mo, Nb, Ta, Sn, Ti, W and Zr. Preferred at Ta, Ti and Zr. Depending on the particular application envisaged suitable anode valve metals are a.o. Al, Mg, Nb, Ta, Ti and Zr, particularly Ta, Ti and Zr.

A method for constructing the special current feeders to be applied in this invention is by employing the feeder as anode in an electrolysis cell with an electrolyte consisting, for instance, of a dilute oxidizing mineral acid, such as sulphuric acid. This technique, known in the art as "anodizing", will produce—by oxidation of the valve metal on the surface of the current feeder—a protective film of the valve metal oxide which is coherent, non-porous and well-adhering to the surface, such film being referred to herein as "anodic" film. It will be appreciated that the core of the current feeder may be constructed from a different materal than the valve metal forming the surface of the current feeder. The core may be constructed for instance, from another metal, or from graphite. When anodizing the current feeder a suitable anode potential is 1 to 30 V, preferably 1.5 to 10 V.

The anodic films on anode feeders can also be formed in situ.

The valve metal oxide film can also be formed by suitable chemical oxidation processes, for instance programmed temperature oxidation in an oxygen containing atmosphere.

Investigations by the Applicants have shown that the thickness of the oxide surface layer has a clear influence on the performance of the current feeder used in the particulate cathode. They have also found that the thickness is closely related to the anode-potential applied during anodizing, the higher this potential, the thicker the metal oxide deposit.

EXAMPLES

Testing of current feeders was carried out in a fluidized bed electrolysis system of 8 l capacity. Electrolyte was circulated from a central holding tank through a cell of rectangular cross-section (~1.5 l capacity) that was divided into two compartments (anode and fluidized bed cathode) with a phenol formaldehyde impregnated polyethylene diaphragm of 10 μm pore size.

The electrolyte used was of nominal concentration 5.0 $g.l^{-1}$ Cu (as CuO) in 70 $g.l^{-3}$ $H_2SO_4$. Before each experiment 800 g copper granules (chopped wire, diameter 1.4 mm, length 1.6 mm) were charged into the cathode compartment. The current feeders of each material tested consisted of 2 mm diameter wires insulated with heat-shrunk pvc tubing leaving only a surface area of 2.0 $cm^2$ uncovered. 3 Feeders were used in the cell in a triangular arrangement with one nearest the diaphragm. Titanium feeders had been anodized at 2.5 and 20 V anode-potential for three minutes, while tantalum and zirconium feeders had been anodized at 10 V, each for 20 minutes, all in deoxygenated 0.5 $mol.l^{-1}$ $H_2SO_4$ electrolyte.

The cell was operated at a bed expansion of 27% (measured by observing the bed height), at a nominal current density on the beads of 1 $mA.cm^{-2}$ (a current of 5.0 A). The cell was run for 6 hours. Then the feeders and the granules were withdrawn, washed with water and acetone, and air dried before weighing to determine the total amounts of copper deposited on the feeder and on the granules.

For comparison, each experiment was run once more under the same conditions apart from employing non-anodized, well polished current feeders. The results of all experiments are shown in the Table.

TABLE

| Feeder | Cu deposit On feeder/mg | Cu deposit % of total |
|---|---|---|
| Ti' | 130 | 0.37 |
| Ti'' | 183 | 0.54 |
| Ti''' | 179 | 0.51 |
| Ti* | 265 | 0.84 |
| Ta | 100 | 0.28 |
| Ta* | 201 | 0.59 |
| Zr | 47 | 0.13 |
| Zr* | 170 | 0.46 |
| Cu* | 344 | 0.97 |

', '', ''', anodized at 2,5 and 20 V respectively
*, for comparison

Application of the novel electrolysis cell of this invention for the electrowinning of metals involves the plating of the metal on the particulate cathode. This may be effected batchwise or in continuous operation, in the latter event relatively small cathode particles e.g. beads, shot, or chopped wire, are continuously introduced into the cathode chamber and cathode particles that have grown in weight by plating are continuously withdrawn. Gas evolving in the anode compartment is also continuously withdrawn from the cell as it would also be in batchwise electrolysis.

The cell would normally be operated at room temperture although elevated temperatures, e.g. up to 70° C., may also be employed. The electrolyte solution is circulated through the cathode chamber at flow rates that would give a bed expansion in the range of from 5 to 35%, 20 to 30% would be typically suitable for commercial operation.

Catholyte concentrations may vary widely. For commercial winning of Cu from $CuSO_4$, the catholyte typically comprises 0.5 to 40 g of Cu, preferably 5 to 25 g. Zn may be won from $ZnSO_4$ electrolyte, typically comprising 1 to 150 g Zn. There is a preference for electroplating particulate cathode material with the same material as that of the cathode, for example lead is deposited on lead shot, copper on chopped copper wire and zinc on zinc granules. However, this is not critical, the metal to be deposited may also be different from the cathode material, provided the separation of deposit and cathode material poses no technical problems. Cell voltage and electrode potentials are adjusted to the various electrolytes and electrodes employed, those skilled in the art will appreciate which combinations can be employed. Selecting the right values forms no part of this invention since the prior art on electrolysis contains enough guiding information.

Since the invention solves the problem of undesired deposition of metal on the current feeders, the life-time of the cell is dramatically increased. Continuous operation of the cell for more than three months has now become, for the first time ever, a realistic possibility.

The same electrolysis cell as described hereinbefore was used for the electrorefining of Cu metal, however the fluidized bed compartment was used as the anode part of the cell, and the conventional compartment was used as the cathode part of the cell. The particulate anode contained Cu-beads, and a Ti current feeder was used. The cathode was a Cu-plate and a polyethylene diaphragm was used. The electrolyte was of nominal concentration of 100 g/l $H_2SO_4$ and 10 g/l Cu. The Ti feederplate was in situ anodized in the fluidized bed electrolysis cell. After addition of the Cu-beads the anodic dissolution was carried out with quantitative current efficiency. No dissolution of the current feeder occurred.

Application of the novel electrolysis cell of this invention for the preparation of metal salt solution involves the dissolution of particulate metal anodes. This may be effected batchwise or in continuous operation, in the latter event metal particles e.g. beads, shot or chopped wire, are more or less continuously introduced into the anode compartment. Gas evolving from the cathode compartment is also continuously withdrawn from the cell.

The cell would normally be operated at room temperature, although elevated temperatures, e.g. up to 70° C., may also be employed, especially in case that the solubility of the metal salt to be prepared is relatively low. The electrolyte solution is circulated through the anode chamber at flow rates that would give a bed expansion of 0 to 50%, usually up to 20%.

All kinds of particulate anode metals may be used, for instance Cu, Zn and Sn, provided that the metals will dissolve under the conditions employed. The metal salt solution obtained may be used for electrodepositing purposes (electrorefining) as described above, or for other purposes.

Anolyte concentration may vary widely. Metal concentrations may be obtained for instance in the case of the preparation of Cu-solutions ot up to 40 g/l. A typical anolyte will comprise from 35 to 135 g $H_2SO_4$, preferably 50 to 100 g.

Cell voltage and electrode potentials are adjusted to the various electrolytes and electrodes employed, those skilled in the art will appreciate which combinations can be employed. Selecting the right values forms no part of this invention since the prior art on electrolysis contains enough guiding information.

Since the invention solves the problem of undesired dissolution of metal current feeders, the life time of the cell is dramatically increased, and continuous operation for several months is possible.

We claim:

1. A fluidized bed electrolysis cell, comprising: one or more particulate electrodes provided with one or more current feeders carrying on their surface artificially created protective film of valve metal oxide formed by anodizing process; and one or more diaphragms for separating the anode compartments from the cathode compartments in the cell.

2. A cell as claimed in claim 1, in which the particulate electrode is the cathode.

3. A cell as claimed in claim 1, in which the particulate electrode is the anode.

4. A cell as claimed in claim 1, 2 or 3, in which the anodizing was carried out employing an anode potential of 1 to 30 V.

5. A cell as claimed in claim 3, in which the protective film of valve metal oxide has been made by anodizing the valve metal film in situ.

6. A cell as claimed in claims 1, 2, 3 or 5, in which the valve metal is tantalum, titanium or zirconium.

7. A cell as claimed in claim 6, in which the current feeder is made of titanium.

8. A fluidized bed electrolysis cell, comprising: one or more particulate electrodes provided with one or more current feeders carrying on their surface a protective film of valve metal oxide formed by a chemical oxidation process, and one or more diaphragms for separating the anode compartments from the cathode compartments of the cell.

9. A cell as claimed in claim 8, in which the particulate electrode is the cathode.

10. A cell as claimed in claim 8 in which the particulate electrode is the anode.

11. A cell as claimed in claims 8, 9 or 10, in which the valve metal is tantalum, titanium or zirconium.

12. A cell as claimed in claim 11, in which the current feeder is made of titanium.

* * * * *